United States Patent [19]

Tourtelot, Jr., deceased et al.

[11] Patent Number: 4,469,056

[45] Date of Patent: Sep. 4, 1984

[54] DUAL FOLLOWER VARIABLE VALVE TIMING MECHANISM

[76] Inventors: Edward M. Tourtelot, Jr., deceased, late of Evanston, Ill.; by John A. Powers, executor, Winston & Strawn, Suite 5000, One First National Plaza, Chicago, Ill. 60603

[21] Appl. No.: 468,321

[22] Filed: Feb. 22, 1983

[51] Int. Cl.[3] ..... F01L 1/34

[52] U.S. Cl. ..... 123/90.16; 123/90.48

[58] Field of Search ..... 123/90.16, 90.48

[56] References Cited

U.S. PATENT DOCUMENTS

| | | | |
|---|---|---|---|
| 2,266,077 | 12/1941 | Roan | 123/90.16 |
| 2,410,411 | 11/1946 | Gregory . | |
| 2,851,851 | 9/1958 | Smith . | |
| 3,157,166 | 11/1964 | MacNeill . | |
| 4,138,973 | 2/1979 | Luria . | |
| 4,204,512 | 5/1980 | Brock, Jr. . | |
| 4,261,307 | 4/1981 | Oldberg . | |

FOREIGN PATENT DOCUMENTS

| | | |
|---|---|---|
| 737353 | 9/1955 | United Kingdom . |

*Primary Examiner*—William R. Cline
*Assistant Examiner*—Peggy A. Neils
*Attorney, Agent, or Firm*—Marshall, O'Toole, Gerstein, Murray & Bicknell

[57] ABSTRACT

A dual follower variable valve timing mechanism for varying the timing of the intake and exhaust valves of an internal combustion engine. Adjacent sets of angularly offset cams are provided on a rotatable camshaft for actuating each valve of the engine, one cam of the set providing a short duration timing and the other cam of the set providing a long duration timing. A first follower for each set of cams has leading and trailing portions having control surfaces which conjointly engage the respective cams. A second, crescent-shaped follower is pivotally mounted in one end of the rocker arm that actuates the valve and has control surfaces which engage the first follower. Links connect the first follower with a crank which is rotatable in opposite directions by a control mechanism responsive to different operating parameters of the engine.

In another embodiment, the first follower includes spaced pair of leading rollers and a central, trailing roller which engage the cams.

In another embodiment, all of the cams are respectively carried on separate camshafts and engage, convex control surfaces on a crescent-shaped follower. A roller is disposed between a concave control surface on the crescent-shaped follower and a convex surface on a rocker arm. One end of the rocker arm engages the stem of the associated valve and the opposite end of the rocker arm engages a lash adjuster.

21 Claims, 23 Drawing Figures

DUAL FOLLOWER VARIABLE VALVE TIMING MECHANISM

BACKGROUND OF THE INVENTION (1) Field of the Invention

This invention relates to a mechanism for varying the timing of the valves of an internal combustion engine, and more particularly relates to a mechanism for varying the time at which the valves of an internal combustion engine open and close, the period during which the valves are open, and the maximum lift thereof in order to optimize the efficiency of the engine under different operating load and speed conditions.

(2) Description of the Prior Art

Various types of mechanisms and devices have been heretofore advanced for varying the timing of the intake and/or exhaust valves of internal combustion engines in order to improve the efficiency and performance of the engine when operating under different speed and load conditions. One such mechanism is disclosed and claimed in my prior U.S. Pat No. 4,205,634, granted June 3, 1980. This mechanism includes a rotatable camshaft having a plurality of conjugate or multi-element cam assemblies thereon, there being one assembly for at least each intake valve of the engine. Each conjugate cam assembly includes an identical pair of axially spaced cams and a smaller and differently contoured cam positioned between the two axially spaced cams. The axially spaced cams are contoured to provide a timing for the associated valve such as will optimize the performance of the engine throughout one operating load and speed range or condition, and the smaller cam is contoured to provide a different timing for the valve such as will optimize the performance of the engine throughout another operating load and speed range or condition.

The mechanism disclosed in U.S. Pat. No. 4,205,634 includes an elongated finger follower positioned between each axially spaced pair of cams and shiftable to a retracted position wherein the follower is out of contact with the central cam for all rotated positions thereof. Consequently, the timing of each valve is controlled solely by the axially spaced pair of cams.

Each finger is also shiftable to an extended position wherein the finger engages the central cam of its assembly throughout at least a portion of or for a complete revolution of the cam assembly. Consequently, the timing of the valve is controlled either by the axially spaced cams, or in part by the axially spaced pair of cams and the central cam, or solely by the central cam. Different valve timings may thus be obtained for optimizing the power and efficiency of the engine for different speed and load conditions by extending or retracting each of the elongated fingers of the mechanism.

In my prior U.S. Pat. No. 4,382,428 granted May 10, 1983, another variable valve timing mechanism is disclosed and claimed which improves upon the mechanism disclosed in my prior U.S. Pat. No. 4,205,634. The mechanism disclosed in my pending patent application employs a single cam for controlling the operation of one of the valves of the engine and an elongated finger follower disposed between the cam and the linkage for effecting movement of the associated valve. Each finger follower has nonplanar control surfaces respectively engaging the cam and linkage means associated therewith, and operating means connected to the proximal end of the finger for shifting the latter relative to the cam member and linkage means in order to vary the timing, duration of the open period, and maximum lift of the valve. The nonplanar or control surfaces on each finger include contiguous portions of decreasing and increasing radius. The aforementioned operating means includes a rotatable shaft and a plurality of cranks interconnecting the shaft and the proximal ends of the respective contoured finger followers. Consequently, each crank is effective to shift the proximal end of the finger associated therewith in an arcuate path and throughout a range of positions such as to cause different portions of the concave control surface of the finger to move into engagement with the cam in accordance with the changing load and speed conditions of the engine.

In addition to the variable valve timing mechanisms disclosed in my prior patent and pending U.S. patent application, a variable valve timing mechanism is disclosed in the Roan U.S. Pat. No. 2,266,077 for varying the timing of the intake and exhaust valves of an internal combustion engine. The mechanism disclosed in the Roan patent employs an arm or yoke for each of the valves of the associated engine, the distal end of the arm being movable between different positions with respect to the cam and a tappet associated with the valve in order to change the timing of the valve. Cam engaging shoes on the distal ends of the arms coact with the cams and their associated tappets to effect changes in the time at which the valve opens and closes, and the period that it remains open, thereby to improve the operating efficiency and performance of the engine for different speed and load conditions. Instead of shoes, the distal or operating ends of the yokes of the Roan variable valve timing mechanism may include one or more tappet rollers for this purpose.

An engine valve control mechanism is also disclosed in the Gregory U.S. Pat. No. 2,410,411, wherein rollers are provided on the cam engaging ends of the rocker arms for the intake and exhaust valves of the engine and wherein variation of the timing of the valves is achieved by lateral shifting of the rocker arms relative to the ends of the valves.

A variable valve control mechanism is also disclosed in the Oldberg U.S. Pat. No. 4,261,307, wherein two angularly arranged pads on an auxiliary rocker arm engage an associated intake valve, the rocker arm being pivotally supported on a shaft adjacent to rhe intake valves of the engine. The shaft upon which the rocker arm for each intake valve is mounted is longitudinally shiftable in a slot in a control arm. Consequently, movement of the shaft on which the auxiliary rocker arms are mounted changes the angular position of the pads of the rocker arm and the position of one of the pads with respect to the cam and cam follower. This changes the time at which the valve closes. The variable valve timing control arrangement disclosed in the Oldberg patent depends upon sequential engagement of two pads with the valve actuating cam to change the timing. In a simplified arrangement, Oldberg employs a single roller between the intake valve cam and its follower to vary the closing time of the valve.

SUMMARY OF THE INVENTION

Briefly described, the present invention contemplates a novel dual follower variable valve timing mechanism for varying the timing of the valves of single or multi-cylinder internal combustion engines in order to optimize the performance and efficiency of such engines under different operating conditions. The mechanism is thus adapted for use with an engine having one or more valves for controlling the flow of gaseous fluid into and out of the combustion chamber or chambers thereof, and linkage means for transmitting movement to the valves.

In one embodiment, to be hereinafter described in detail, the mechanism includes a rotatable camshaft that is driven in timed relation with the speed of the engine and having a plurality of cam means thereon, one for each valve. The cam means includes a first cam member that is contoured to provide a first timing for its associated valve such as will achieve optimum performance and efficiency of the engine throughout one set of operating conditions, and a second cam member provided by a pair of spaced cam sections which are respectively disposed on opposite sides of the first cam member and which are contoured to provide a second timing for the associated valve which will obtain optimum performance and efficiency of the engine throughout another set of operating conditions. The mechanism also includes first follower means having leading and trailing portions having control surfaces thereon for engaging the first and second cam members, and another control surface on a second follower means that is pivotally mounted in one end of the rocker arm for the valve. Operating means in the form of one or more links are connected to the first follower means and serves to shift the latter between positions wherein the times at which the associated valve opens and closes, the period during which the valve is open, and the maximum lift of the valve, is controlled primarily by either the first or the second cam member.

In another embodiment, the first follower means is in the form of a unitary support member having laterally spaced flange portions and connecting leading and trailing web portions which are provided with control surfaces for engaging the control surface of the second follower means. Rollers are carried by the flange portions for engaging the first cam member and the spaced sections of the second cam member. The support member and the rollers thereof are pivotally carried at the inner end of the links of the operating means of the mechanism.

In a further embodiment, the cam members for each valve of the engine are carried on separate camshafts which extend transversely to and are d sposed above the rocker arms of the linkage which actuates the valves. In this embodiment, one of the follower means of each mechanism includes spaced, convex, control surfaces which respectively engage the cams on the spaced camshafts and a second follower means in the form of a roller which engages a concave control surface on the opposite side of the first follower means and a convex control surface on the rocker arm. In this embodiment, the operating means of the mechanism includes one or more links that are connected to the roller and serve to shift the roller to different positions between the concave control surface on the first follower means and the convex control surface on the rocker arm so that the times at which the associated valve opens and closes, the period during which the valve is open, and the maximum lift of the valve, may be controlled primarily by either the first or the second cam member, or by both cam members.

DESCRIPTION OF THE PREFERRED EMBODIMENTS

Figure 1:
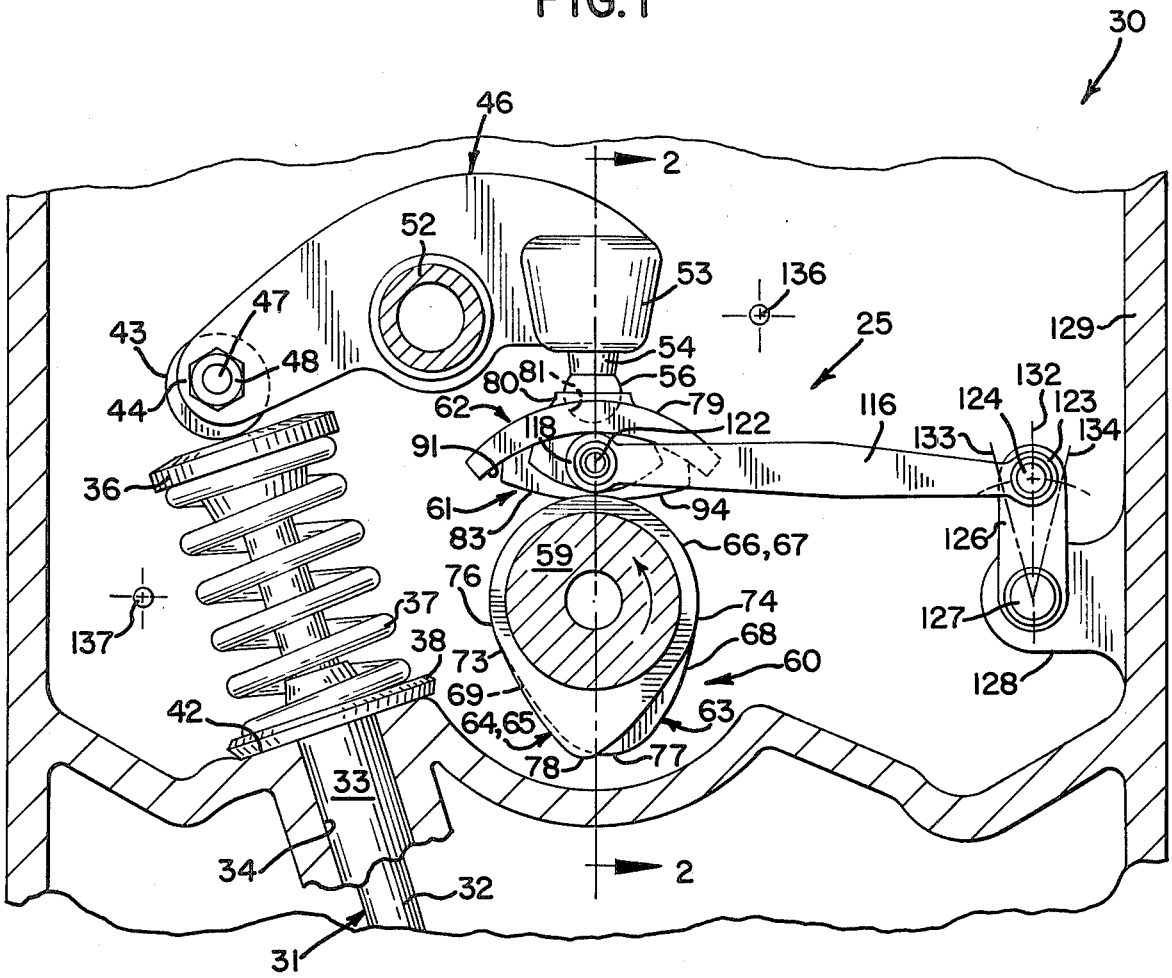
FIG. 1 is a vertical sectional view, with some parts in elevation, of a portion of the cylinder head of an internal combustion engine incorporating a dual follower variable valve timing mechanism embodying the features of the present invention for varying the timing of one of the valves of the engine.

In FIG. 1, a portion of the cylinder head, indicated at 30, of a multi-cylinder, internal combustion engine is illustrated. The engine includes a cylinder block (not shown) having a plurality of cylinders (also not shown) therein and a plurality of pistons (likewise not shown) which are mounted in the cylinders for reciprocating movement.

The cylinder head 30 further includes intake and exhaust passages for each cylinder, and at least one intake and at least one exhaust valve for controlling the flow of gaseous fluids through the intake and exhaust passages, respectively. As illustrated in FIG. 1, one of the intake valves of the engine is indicated generally at 31, and a portion of the stem thereof is indicated at 32. The stem 32 is shiftably mounted in a guide 33 which is mounted in a bore 34 in the cylinder head 30. A spring retainer 36 is secured to the upper end of the valve stem 32 by a tapered, split keeper (not shown) the retainer 36 providing a seat for upper coil of a valve spring 37. The lower coil of the spring 37 engages a cup-shaped seat 38 which surrounds the guide 33 and engages a flat surface 42 on the cylinder head 30. The valve also includes a head (not shown) for opening and closing the intake passage for the associated cylinder.

The upper end (not shown) of the valve stem 32 engages a wheel-type lash adjuster 43 which is eccentrically mounted in one end 44 of a rocker arm 46 such as by an eccentric shaft 47 and which is retained in an adjusted position by a lock nut 48. The rocker arm 46 is rockably mounted on a shaft 52 that is supported at various points on the cylinder head 30 of the engine in a conventional manner. The opposite end 53 of the rocker arm 46 preferably includes an integral, depending portion 54 which terminates in a ball 56. The purpose of the ball 56 will be described in greater detail hereinafter.

According to the present invention, the mechanism 25 of the present invention includes cam means, indicated generally at 60, for effecting rocking movement of the rocker arm 46 and opening and closing of the valve 31, and dual follower means comprising a first follower means or member 61 engaged with the cam means 60 and a second follower means or member 62 engaged with the first follower member 61 and the ball 56. The follower members 61 and 62 coact with the cam means 60 to vary the time at which the valve 31 opens and closes, in relation to its associated piston, in order to achieve the advantages of the present invention.

Each cam means 60 is formed integrally with a camshaft 59, which extends lengthwise of the cylinder head 30, and is preferably of the conjugate type. Thus, each cam means 60 includes a central, first radial cam member 63 and at least one and preferably a pair of axially spaced, second radial cam members or sections 64 and 65, respectively disposed on opposite sides of the central cam member 63. The base circle portion of the central cam member 63 is indicated at 66 and the base circle portions of the cam members 64 and 65 are indicated at 67. The opening and closing ramp portions of the cam member 63 are respectively indicated at 68 and 69, and the opening and closing ramp portions of the cam members 64 and 65 are respectively indicated at 72 and 73. The transition points between the base circles 66 and 67 and opening ramp portions 68 and 72 of the cam members 63–65, are indicated at 74 in FIG. 1 and the transition points between the closing ramp portions 69 and 73 and base circle portions 66 and 67 of the cam members 64,65 are indicated at 76 in FIG. 1. The high point of the cam member 63 is indicated at 77 and the high points of the cam members 64 and 65 are indicated at 78.

Figure 2:
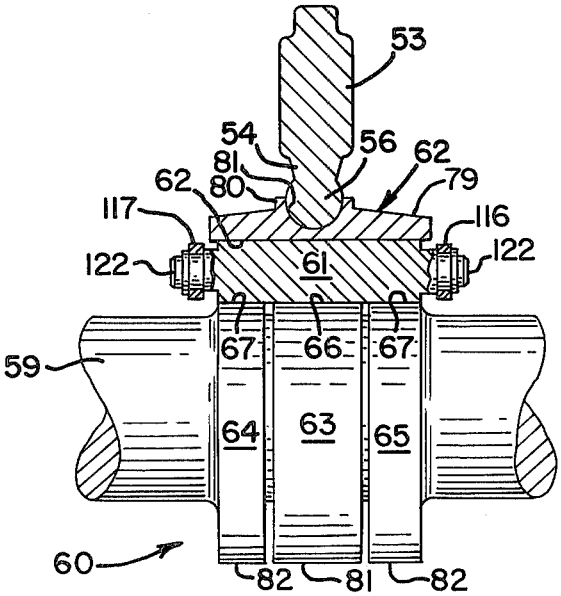
FIG. 2 is a fragmentary, vertical sectional view, with some parts in elevation, taken substantially along the line 2—2 of FIG. 1.
Figure 3:
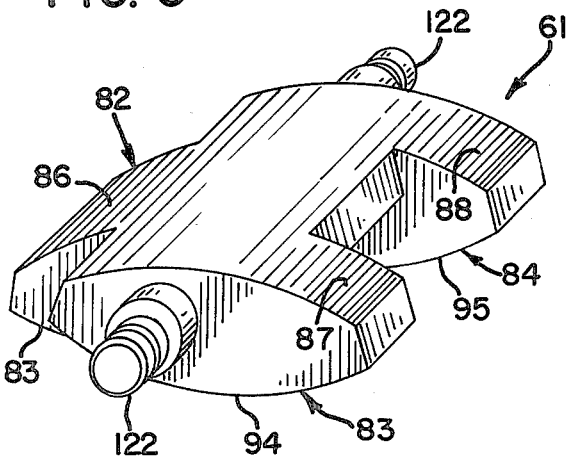
FIG. 3 is an enlarged perspective view of one of the followers of the dual follower variable valve timing mechanism illustrated in FIG. 1.
Figure 4:
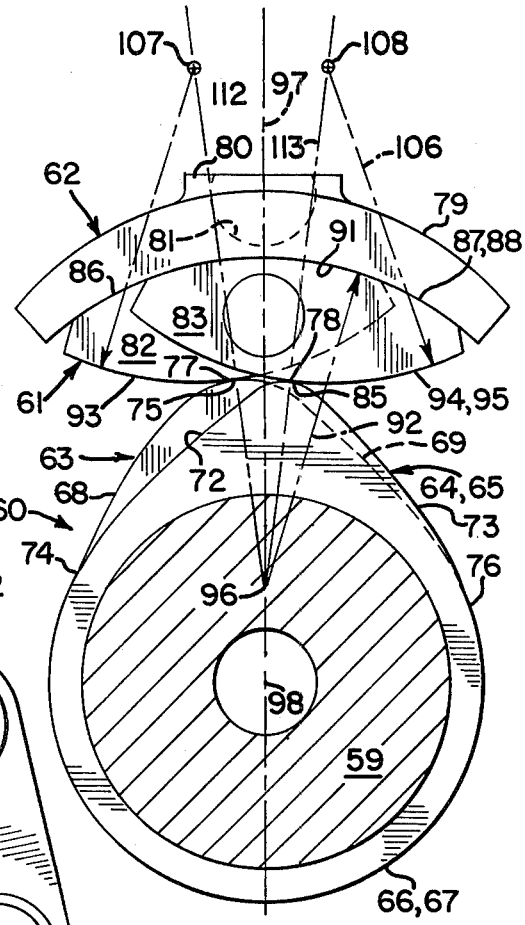
FIG. 4 is an enlarged, vertical sectional view, with some of the parts thereof in elevation, of the principal components of the dual follower variable valve timing mechanism illustrated in FIG. 1 and showing the approximate location of the centers and lengths of the radii of curvature of the control surfaces on the dual followers of the mechanism in relation to the camshaft and cams thereof.

Referring now to FIG. 4 in conjunction with FIGS. 1, 2 and 3, it will be seen that the follower member 61 is of a generally truncated, ellipsoidal shape and includes a central, trailing portion 82 and a pair of adjoining, laterally spaced leading portions 83 and 84. The trailing portion 82 has an upper, nonplanar, control surface 86 and the leading portions 83 and 84 likewise have upper, nonplanar control surface portions 87 and 88, respectively. The control surfaces 86, 87, and 88 are preferably segments of cylinders having the same radius of curvature, the length of which is represented by the length of the arrow 92 in FIG. 4. The underside of the second follower member 62 is indicated at 91 and is likewise preferably a segment of a cylinder having the same radius of curvature as the control surfaces 86, 87 and 88. The upper surface, indicated at 79, of the second follower member 62 includes a boss 80 which is provided with a concave recess 81 that defines a seat for the ball 56.

The principal components of the mechanism 25 are shown in FIG. 4 in symmetrical relationship when the follower member 61 has been adjusted to cause the open period of the associated valve to be of intermediate duration and with the high point 77 of the cam member 63 engaged with the midpoint, indicated at 75, of the under or control surface, indicated at 93, of the trailing portion 82 and with the high points 78 of the cam members 64 and 65, respectively engaged with the midpoints, indicated at 85, of the under or control surfaces, indicated at 94 and 95 of the leading portions 83 and 84. For the condition illustrated in FIG. 4, the center of the radius of curvature of the control surfaces 86, 87 and 88, as well as the concave undersurface 91 of the follower member 62, is indicated by the point 96 at the lower end of the arrow 92. The point 96 lies on a line 97 that intersects the axis of rotation, indicated at 98, of the camshaft 59, the midpoints 85 and 75 of the lower surfaces 94,95 and 93 of the leading and trailing portions 83,84 and 82, respectively, of the follower member 61, and the geometric centers of the follower members 61 and 62.

The radius of curvature of the lower, nonplanar, control surface 93 on the trailing section 82 is represented by the length of the arrow 103 in FIG. 4 and the radius of curvature of the lower, nonplanar control surfaces 94 and 95 on the leading sections 83 and 84 of the follower member 61 are represented by the arrow 106 in FIG. 4. The centers of the radii of curvature of the surface 93 and the surfaces 94 and 95 are indicated at 107 and 108, respectively, and lie on lines 112 and 113, respectively, which intersect the point 96 and the high points 77 and 78 of the cam members 63 and 64, 65, respectively. The angle between the lines 97 and 112 is preferably about $7\frac{1}{2}°$ and the angle between the lines 97 and 113 is also preferably about $7\frac{1}{2}°$. Thus, the centers 107 and 108 of the radii of curvature of the control surfaces 93 and 94, 95 are disposed substantially oppositely from the center 96 of the radius of curvature of the control surfaces 86 and 87, 88. It should be understood, however, that the lengths and centers of the radii of curvature of the control surfaces 86, 87, 88 and 93, 94 and 95 could be other than as illustrated in FIG. 4 and described above, depending upon the location and geometry of the components of the engine which incorporates the dual follower variable valve timing mechanism of the present invention.

Referring again to FIG. 1, it will be seen that the first follower member 61 is shiftable substantially transversely to the direction of movement imparted thereto by the cam means 60. Such movement is effected by operating means which includes at least one and preferably a pair of laterally spaced links 116 and 117 (FIGS. 1 and 2), only the link 116 being shown in FIG. 1. The inner or left ends of the links 116 and 117 are formed into eyes 118 (FIG. 1) and receive trunnions 122 which extend outwardly from each side of the follower member 61. The opposite or right ends of each of the links 116 and 117 are likewise formed into eyes 123 and are connected by pins 124 to the upper end of at least one and preferably a pair of cranks, one of which is indicated at 126 in FIG. 1.

The lower ends of the cranks 126 are fixedly secured to a shaft 127, which is mounted for limited rotational movement in bosses, one of which is indicated at 128 in FIG. 1, carried on the side wall, indicated at 129, of the cylinder head 30 of the engine. When the crank 126 is in its full line position illustrated in FIG. 1, the center line thereof, indicated at 132, extends substantially vertically, as shown in this figure. Such position will result in the period during which the valve 31 remains open to be of "intermediate" duration. The rotated limit positions of the crank 126 in opposite directions from the full line position thereof illustrated in FIG. 1 are indicated by the inclined positions of the centerlines 133 and 134 and correspond to open periods of the valve 31 which may be characterized as of "short" and "long" duration, respectively.

Rotation of the shaft 127 in opposite directions to cause the crank 126 to swing between the positions thereof represented by the centerlines 133 and 134 in FIG. 1, is effected by a control mechanism (not shown) which is responsive to one or more operating conditions of the engine, such as engine speed and manifold vacuum. The shaft 127 could, however, be rotated manually to cause pivotal movement of the crank 126 between the aforementioned angular positions.

Figure 5:
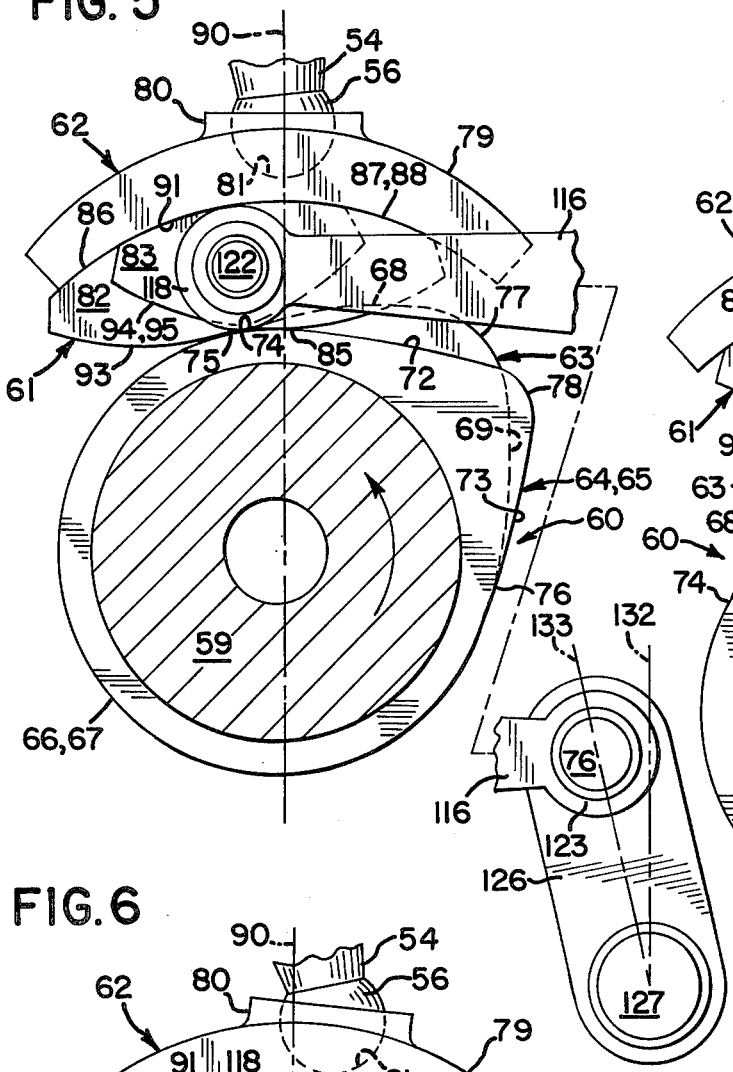
FIG. 5 is an enlarged, sectional view, similar to FIG. 4, showing the approximate positions of the principal components of the dual follower variable valve timing mechanism illustrated in FIG. 1 when the associated valve is starting to lift and the mechanism has been adjusted to cause the period during which the valve remains open to be of relatively short duration.

Referring now to FIGS. 5–16, inclusive, in conjunction with FIGS. 1 and 2, the manner in which the dual follower members 61 and 62 coact with the cam means 60 of the mechanism 25 of the present invention to vary the timing of the valve 31 for different operating conditions of the engine will now be described. In this regard, and initially referring to FIGS. 5–8, inclusive, it will be assumed that the control mechanism, which effects rotation of the shaft 127, has caused the shaft to swing the crank 126 to the approximate position thereof illustrated in FIG. 5. When so positioned, the midpoint 85 of the control surfaces 94,95 is in substantial alignment with the line of action, approximately indicated at 90, of the force exerted by the cam means 60 on the ball 56 of the rocker arm 46. It will further be assumed that the opening ramp portions 72 of the cam members 64 and 65 have moved into engagement with control surfaces 94 and 95 of the leading portions 83 and 84 of the follower member 61, but that the transition point 74 of the cam member 63 has just or is about to contact the midpoint 75 of the control surface 93 of the trailing portion 82 of the follower member 61. Consequently, FIG. 5 illustrates the positions of the parts of the mechanism 25 at the beginning of the lift cycle of the valve 31 and at about the time when the opening ramp portion 68 of the cam member 63 begins to exert its effect on the lift curve of the valve 31, in addition to the effect exerted by the opening ramp portion 72 of the cam members 64 and 65. Consequently, the lift curve of the valve 31 will be a composite of the curves imparted by the opening ramp portions 72 of the cam members 64 and 65 and the opening ramp portion 68 of the cam member 63. However, since the midpoint 85 of the control surfaces 94,95 of the leading portions 83,84, and the geometric center of the leading portions 83,84 substantially lie on the line of the action 90, the contour of the lift curve of the valve 31 will be determined primarily by the cam members 64,65.

Figure 6:
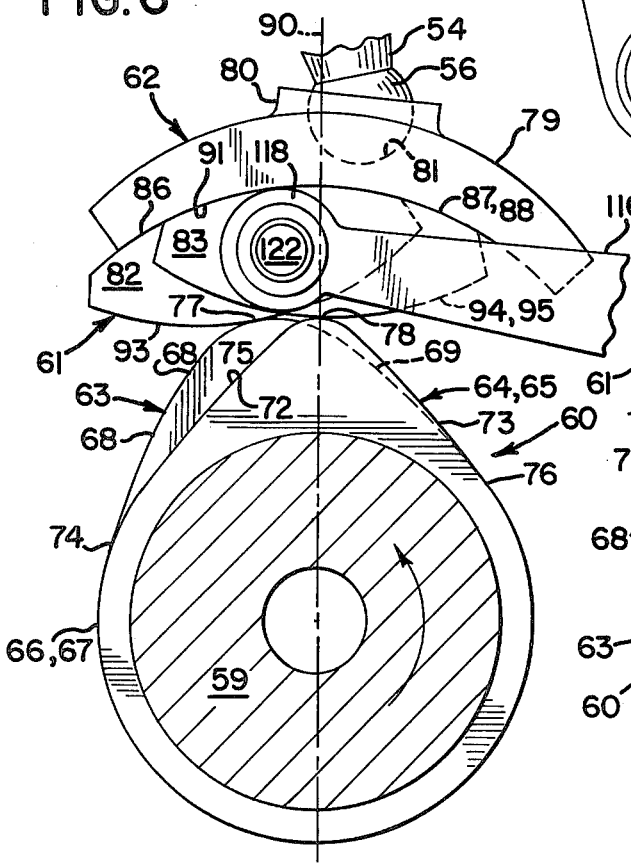
FIG. 6 is a view similar to FIG. 5 but showing the approximate positions of the parts of the mechanism when the high points of the cams are positioned to cause the associated valve to be at maximum lift.

Rotation of the camshaft 59 in a counterclockwise direction from the position thereof illustrated in FIG. 5 to the position thereof illustrated in FIG. 6 will bring the high points 77 and 78 of the cam members 63 and 64, 65 into substantial alignment with the midpoints 75 and 85 of the control surfaces 93 and 94,95, respectively. Consequently, the valve 31 will then be at its maximum lift position at this time. Since it has been assumed that the follower member 61 has been shifted to its "short" duration position illustrated in FIG. 5, and since the camshaft 59 is moving in a counterclockwise direction as viewed in FIGS. 5–7, inclusive, the valve 31 will begin to lift off its seat later, reach its maximum lift position sooner, and seat sooner than it would if the follower member 61 were in its "normal" position illustrated in FIG. 1 or in its "long" duration position illustrated in FIGS. 13–15, inclusive.

Figure 7:
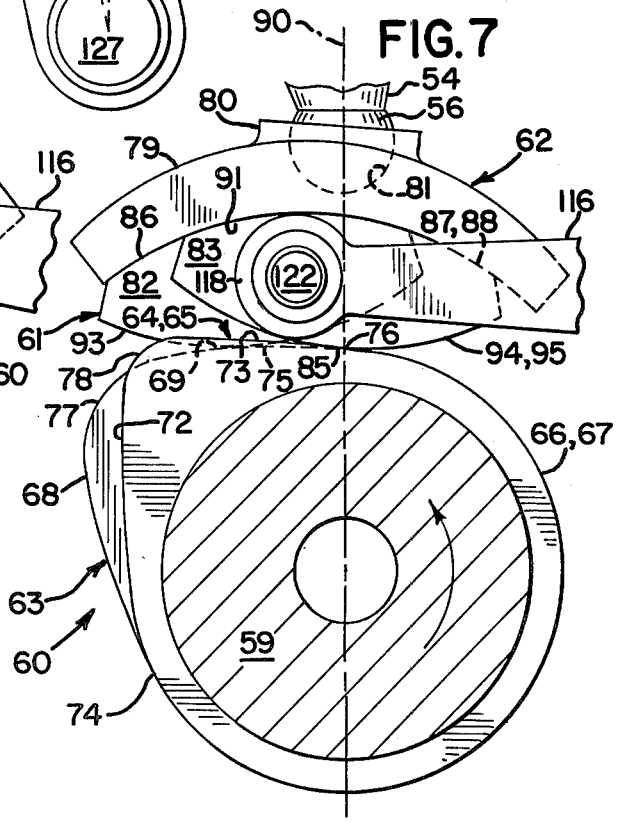
FIG. 7 is a view similar to FIG. 5 but showing the approximate positions of the parts of the mechanism when the associated valve is about to close.

Continued counterclockwise rotation of the camshaft 59 from the position thereof illustrated in FIG. 6 to the position thereof illustrated in FIG. 7 will result in movement of the valve toward its closed or seated position. The contour of the lift curve of the valve during this period is also determined primarily by the cam members 64,65.

Figure 8:
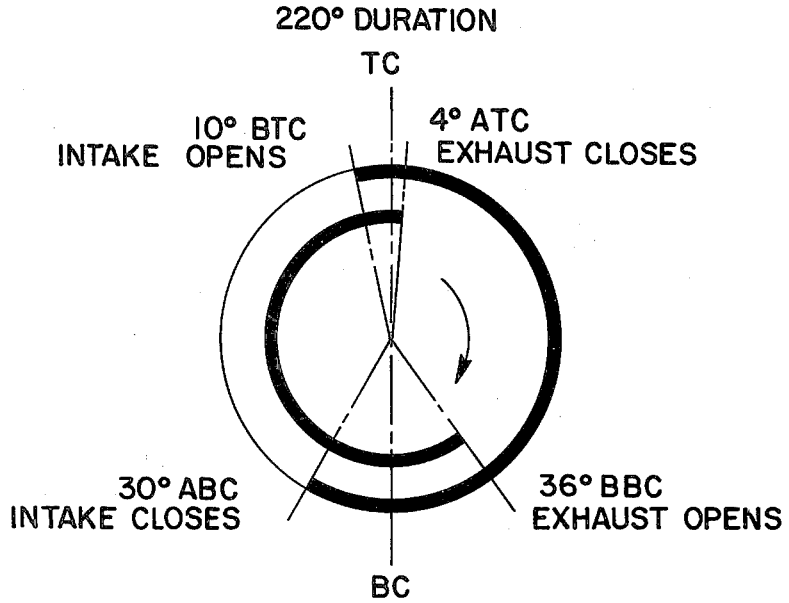
FIG. 8 is a timing diagram for the intake and exhaust valves for one of the cylinders of an internal combustion engine incorporating the dual follower variable valve timing mechanism of the present invention and showing the approximate opening and closing points of the intake and exhaust valves, in degrees of crankshaft rotation, when the mechanism has been adjusted to cause the open period for the valves to be of relatively short duration, i.e. approximately 220°.

FIG. 8 illustrates the approximate timing of the intake valve 31, and a corresponding exhaust valve (not shown), in relation to the position of the piston in the cylinder of an engine incorporating the dual follower variable valve timing mechanism 25. Such timing is indicated in degrees of crankshaft rotation and is obtained when the follower member 61 of the mechanism 25 associated with the valves is positioned as shown in FIGS. 5–7, inclusive, and is of "short" duration. Assuming that a dual follower variable valve timing mechanism 25 is provided for each of the other intake and exhaust valves of the engine, the timing thereof, in relation to the positions of their respective pistons, is the same as illustrated in FIG. 8.

While not shown in the drawings, a cam means, similar to the cam means 60, is provided on the camshaft 59 for each exhaust valve of the engine and dual follower members (also not shown), similar to the follower members 61 and 62, are provided for each exhaust valve for coaction with the associated cam means. The exhaust valve cam means is formed integrally with the camshaft 59 and, like the cam means 60, is preferably of the conjugate type. Thus, the cam means for each exhaust valve includes a central, first radial cam member and at least one and preferably a pair of axially-spaced, second radial cam members, respectively disposed on opposite sides of the central cam member.

Each exhaust valve cam means coacts with the follower members associated therewith to effect rocking movement of a rocker arm (not shown), similar to the rocker arm 46 and mounted on a shaft (also not shown) similar to the shaft 52. The axis of the shaft for the exhaust valve rocker arms is indicated at 136 in FIG. 1.

Transverse movement of the first follower member for each exhaust valve is effected by a laterally spaced pair of links (not shown), similar to the links 116 and 117, and by cranks (also not shown), similar to the cranks 126, connected to the outer ends of the links. The lower ends of the exhaust valve cranks are likewise secured to a shaft (not shown), which extends lengthwise of the cylinder head 30 and which is mounted for limited rotational movement in bosses on the inner side of the side wall 129 of the cylinder head 30, similar to the bosses 128. The axis of rotation of the shaft which effects swinging movement of the exhaust valve cranks is indicated at 137 in FIG. 1.

The approximate timing of each exhaust valve of the engine, when the transversely shiftable follower member of the mechanism 25 associated therewith has been adjusted to provide a "short" duration cycle, is illustrated in FIG. 8. Such timing is indicated in degrees of crankshaft rotation in relation to the position of the piston in the cylinder with which the valve is associated.

Figure 9:
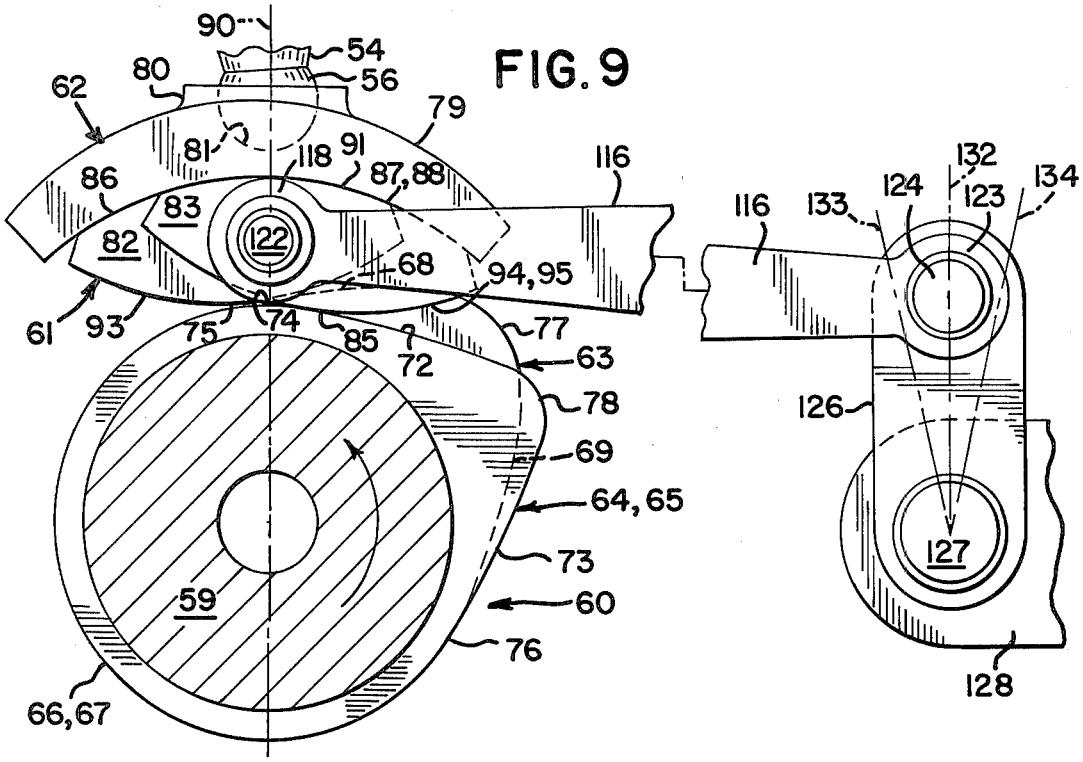
FIG. 9 is a view similar to FIG. 5 but showing the approximate positions of the principal components of the dual follower variable valve timing mechanism of the present invention as they would appear when the associated valve is starting to lift and the mechanism has been adjusted to cause the open period of the valve to be of intermediate or normal duration.
Figure 10:
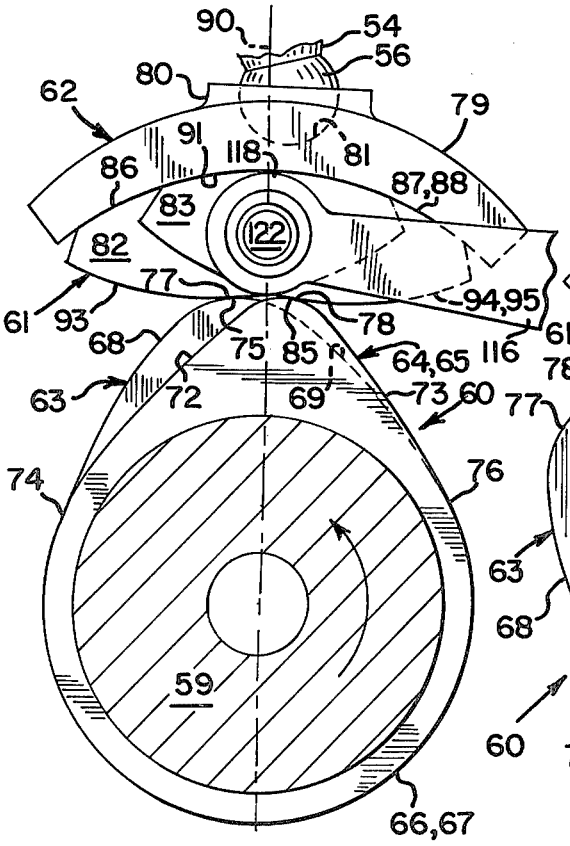
FIGS. 10 and 11 are views similar to FIGS. 6 and 7 but showing the positions of the parts of the mechanism when the associated valve is at maximum lift and is about to close, respectively.
Figure 11:
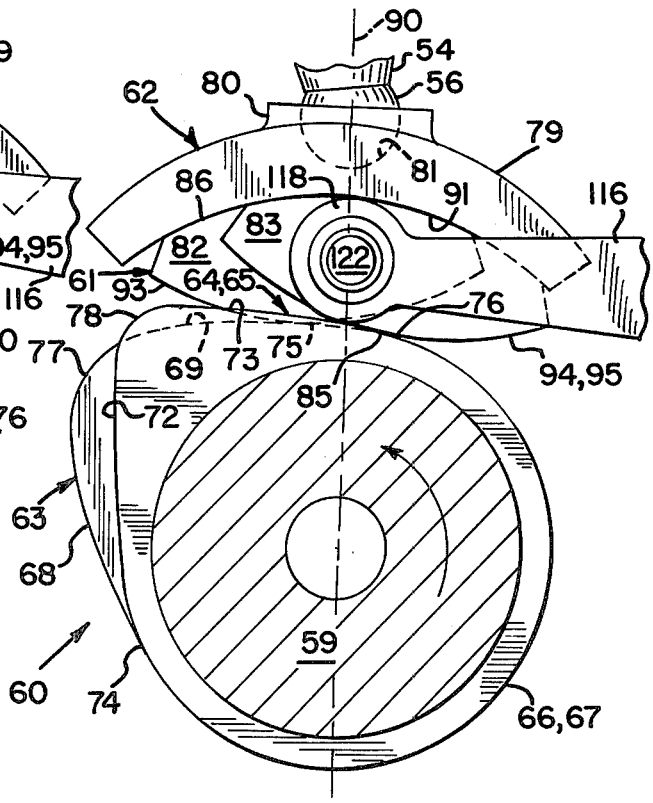

Referring now to FIGS. 9, 10 and 11, in conjunction with FIG. 1, the principal components of the mechanism 25 are illustrated in the approximate positions they would occupy when adjusted to optimize the efficiency and performance of the engine in which the mechanism is installed when the engine is operating under normal speed and load conditions. Such adjustment provides what may be termed an "intermediate" duration of the intake valve 31 of the engine. Thus, when the mechanism 25 has been adjusted to cause the open period of the valve 31 to be of intermediate duration, the line of action 90 of the force exerted by the cam means 60 on the ball 56 will pass between the midpoints 75 and 85 of the control surfaces 93 and 94,95, respectively, throughout each operating cycle of the cam means 60. In addition, the opening ramp portions 72 of the cam members 64 and 65, and the opening ramp portion 68 of the cam member 63 will engage their respective control surfaces 94,95 and 93 on the follower member 61 earlier than they would when the follower member 61 is in its "short" duration position illustrated in FIGS. 5–7, inclusive. The closing ramp portions 73 of the cam members 64 and 65 and the closing ramp portion 69 of the cam member 63 likewise move out of engagement with their respective control surface portions 94,95 and 93 later than they would when the follower member 61 is in its short duration position illustrated in FIGS. 5–7, inclusive. However, since the line of action 90 of the force exerted by the cam means 60 on the ball 56 passes between the geometric centers of the leading and trailing portions 83,84 and 82 and between the midpoints 85 and 75 of the control surfaces 94,95 and 93, respectively, the contour of the lift curve of the valve 61 will be an integrated composite of the curves that would be obtained from either the cam members 64,65 or the cam member 63 alone.

FIG. 10 illustrates the positions of the principal components of the dual follower variable valve timing mechanism 25 when the high points 77 and 78 of the cam members 63 and 64,65, respectively, are engaged with the midpoints 75 and 85 of their respective control surfaces 93 and 94,95 on the follower member 61. At this time, the valve 31 will be at its maximum lift position.

FIG. 11 illustrates the positions of the parts of the mechanism 25 as the intake valve 31 is nearing its closed or seated position. Thus, the base circle portions 67 of the cam members 64 and 65 are beginning to engage the control surfaces 94,95 of the leading portions 83,84 and the base circle portion 66 of the cam member 63 is about to move into engagement with the control surface 93 of the trailing portion 82.

Figure 12:
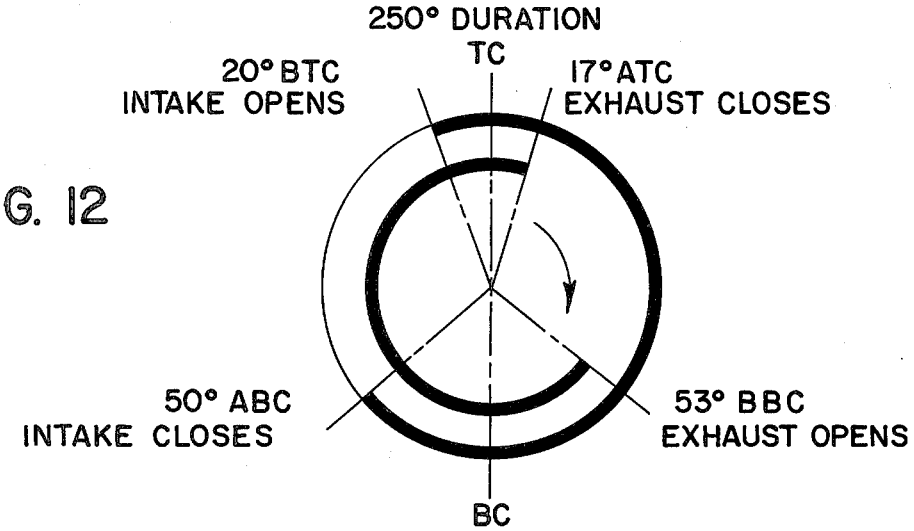
FIG. 12 is a timing diagram for the intake and exhaust valves of one of the cylinders of an internal combustion engine incorporating the dual follower variable valve timing mechanism of the present invention and showing the approximate opening and closing points of the intake and exhaust valves, in degrees of crankshaft rotation, when the mechanism has been adjusted to cause the open period for the valves to be of relatively normal duration, i.e. approximately 250°.

FIG. 12 illustrates the approximate timing of the intake valve 31, and a corresponding exhaust valve (not shown), in relation to the position of the piston in the cylinder of an engine incorporating the dual follower variable valve timing mechanism 25. Such timing is in degrees of crankshaft rotation, and is obtained when the follower member 61 of the mechanism 25 associated with the valves is positioned as shown in FIGS. 9–11, inclusive, and is of "intermediate" duration. Assuming that a dual follower variable valve timing mechanism 24 is provided for each of the other intake and exhaust valves of the engine, the timing thereof, in relation to the positions of their respective pistons, is the same as illustrated in FIG. 12.

Figure 13:
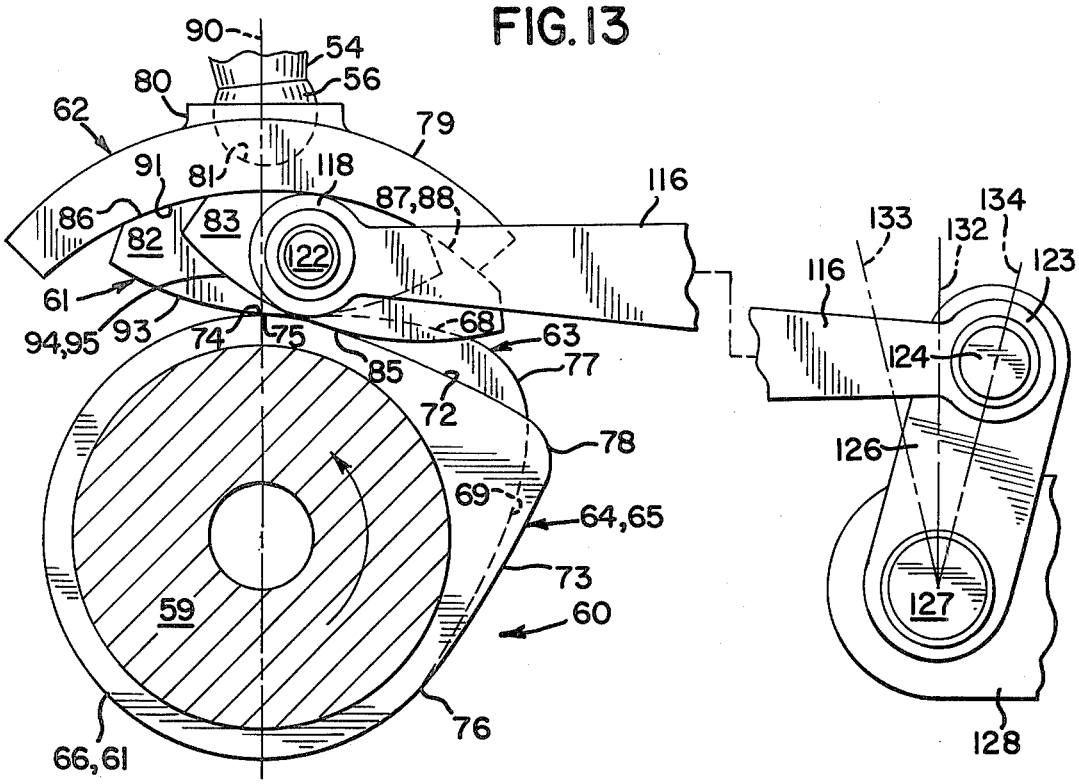
FIG. 13 is a view similar to FIG. 5 but showing the approximate positions of the principal components of the dual follower variable valve timing mechanism of the present invention as they would appear when the associated valve is starting to lift and the mechanism has been adjusted to cause the open period of the valve to be of relatively long duration.
Figure 14:
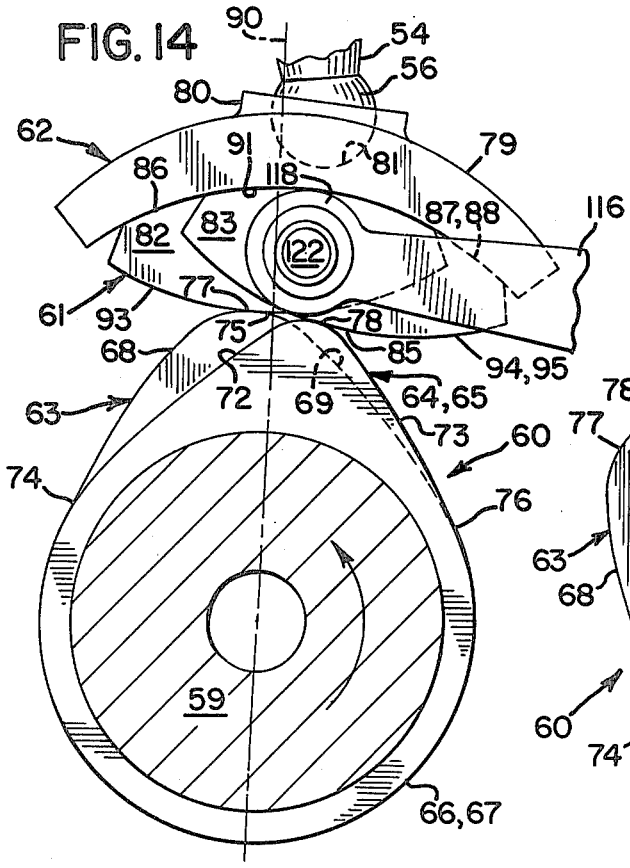
FIGS. 14 and 15 are views similar to FIGS. 10 and 11 but showing the positions of the parts of the mechanism when the associated valve is at maximum lift and is about to close, respectively.
Figure 15:
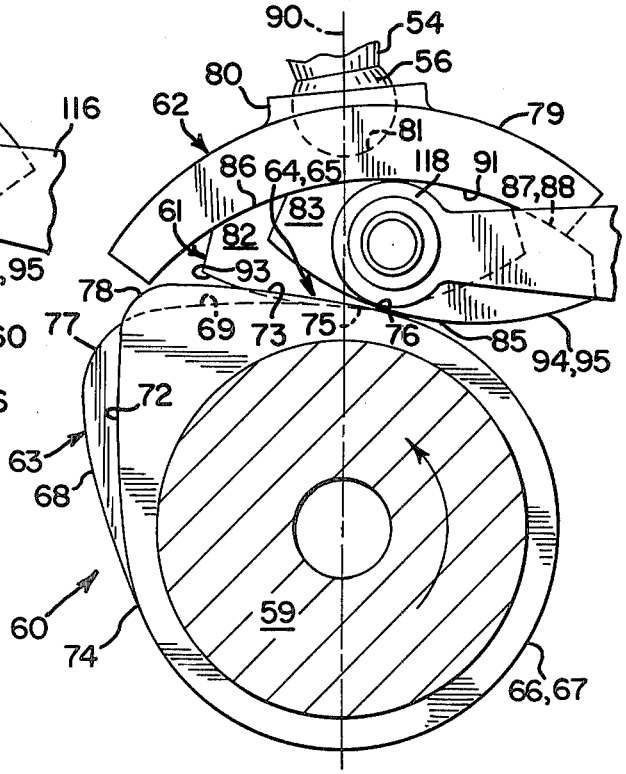

Referring now to FIGS. 13, 14 and 15, in conjunction with FIG. 1, the principal components of the mechanism 25 are illustrated in the approximate positions they would occupy when the mechanism is adjusted to optimize the efficiency and performance of the engine when the latter is operating under a relatively high speed, moderate, to light load condition. When adjusted for this operating condition, the period during which the intake valve remains open is what may be termed "long" duration. Adjustment of the mechanism 25 to achieve this duration period is obtained when the shaft 127 is rotated so that the crank 126 is positioned as illustrated in FIG. 13. When so positioned, the midpoint 75 of the control surface 93 is in substantial alignment with the line of action 90 of the force exerted by the cam means 60 on the ball 56 of the rocker arm 46. The midpoints 85 of the control surfaces 94,95 are to the right of the line 90, as viewed in this and FIGS. 14 and 15. In addition, the opening ramp portions 72 of the cam members 64 and 65, and the opening ramp portion 68 of the cam member 63 will engage their respective control surfaces 94,95 and 93 on the follower member 61 earlier than they would when the follower member is positioned in its "intermediate" duration position illustrated in FIGS. 9–11, inclusive. The closing ramp portion 73 of the cam members 64 and 65, and the closing ramp portion 69 of the cam member 63, likewise move out of engagement with their respective control surface portions 94,95 and 93 later than they would when the follower member 61 is in its intermediate duration position illustrated in FIGS. 9–11, inclusive. However, since the line of action of the force exerted by the cam means 60 on the ball 56 substantially passes through the geometric center of the trailing portion 82 and the midpoint 75 of the control surface 93, the contour of the lift curve of the valve 31 will be determined primarily by the cam member 63.

FIG. 14 illustrates the positions of the principal components of the dual follower variable valve timing mechanism 25 when the high points 77 and 78 of the cam members 63 and 64,65, respectively, are engaged with their respective control surfaces 93 and 94,95 on the follower member 61. At this time, the valve 31 will be at its maximum lift position.

FIG. 15 illustrates the positions of the parts of the mechanism 25 as the intake valve 31 is nearing its closed or seated position. Thus, the base circle portions 67 of the cam members 64 and 65 have already moved into engagement with the control surfaces 94,95 of the leading portions 83,84 but the base circle portion 66 of the cam member 63 has not yet moved into engagement with the control surface 93 of the trailing portion 82.

Figure 16:
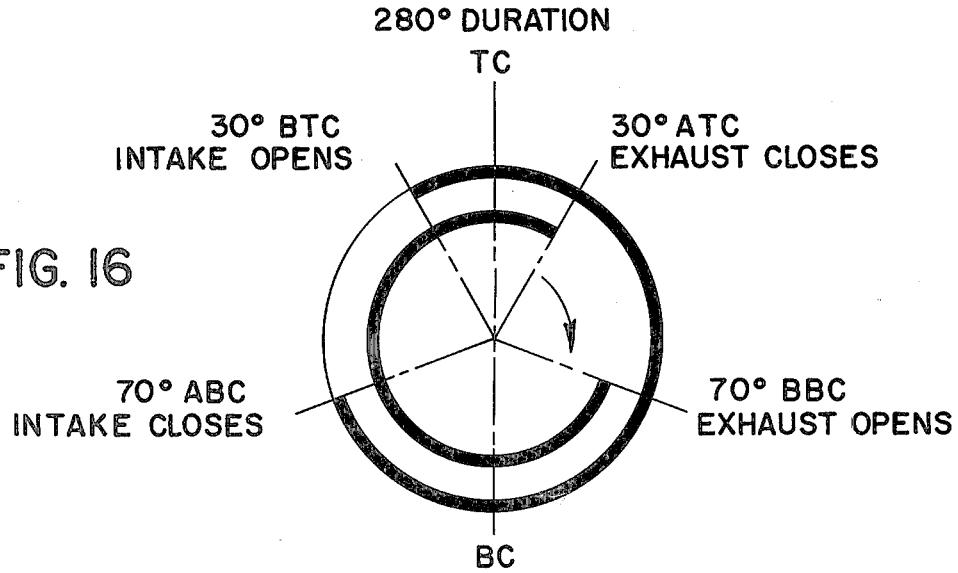
FIG. 16 is a timing diagram for the intake and exhaust valves for one of the cylinders of an internal combustion engine incorporating the dual follower variable valve timing mechanism of the present invention and showing the approximate opening and closing points of the intake and exhaust valves, in degrees of crankshaft rotation, when the mechanism has been adjusted to cause the open period for the valves to be of relatively long duration i.e. approximately 280°.

FIG. 16 illustrates the approximate timing of the intake valve 31, and a corresponding exhaust valve (not shown), in relation to the piston in the cylinder of an engine incorporating the dual follower variable valve timing mechanism 25. Such timing is indicated in degrees of crankshaft rotation and is obtained when the transversely shiftable follower member 61 of the mechanism 25 associated with the valves is positioned as shown in FIGS. 13–15, inclusive, and is of "long" duration. Assuming that a dual follower variable valve timing mechanism 25 is provided for each of the intake and exhaust valves of the engine, the timing thereof, in relation to the positions of their respective pistons, is the same as illustrated in FIG. 16.

It will be understood that intermediate timings for the intake and exhaust valves of an engine incorporating the dual follower variable valve timing mechanism 25 could be obtained by positioning the crank 126 of each mechanism at positions other than those represented by the centerlines 132, 133 and 134 thereof in FIGS. 5, 9 and 13.

THE DUAL FOLLOWER VARIABLE VALVE TIMING MECHANISM 145

Figure 17:
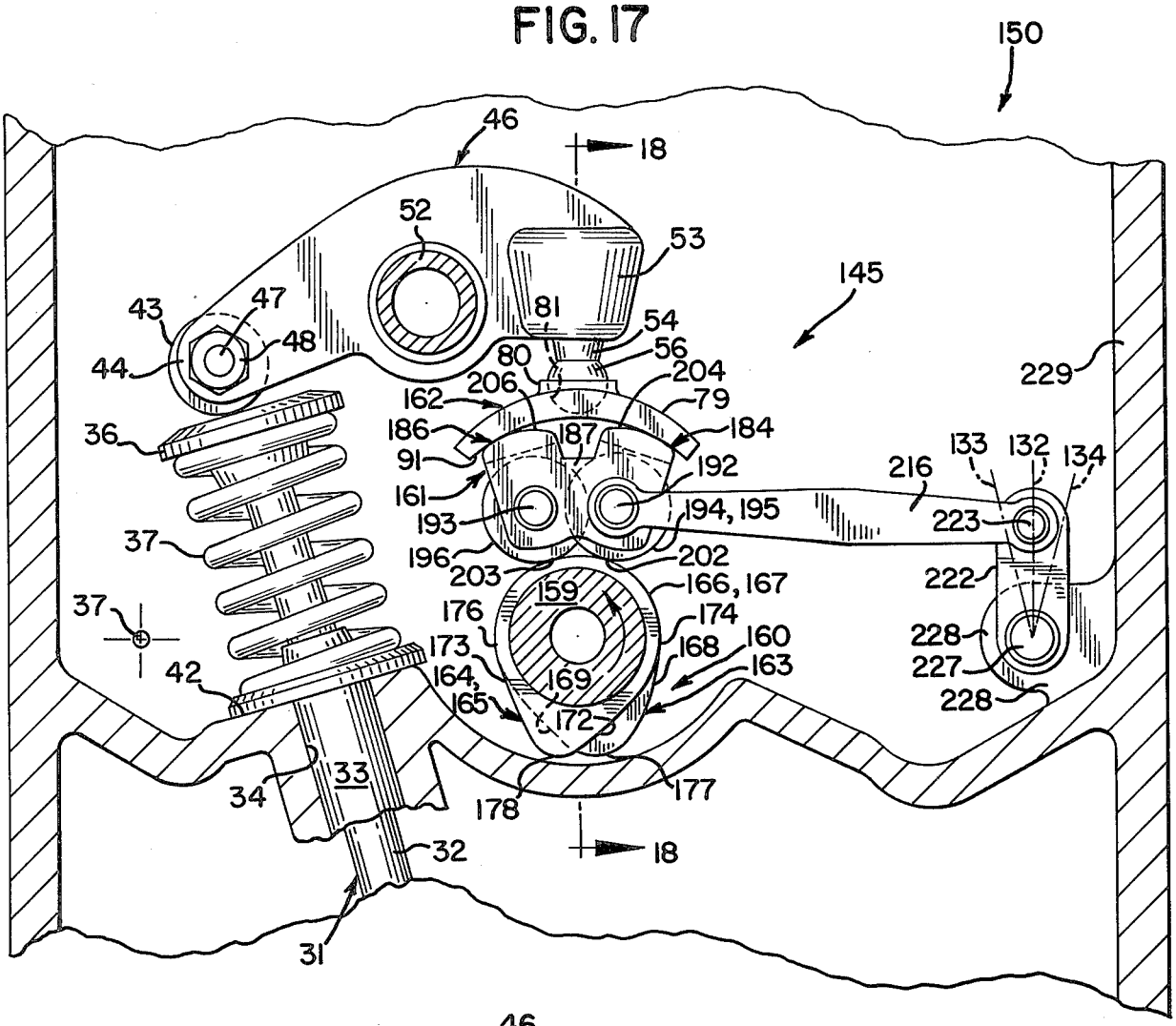
FIG. 17 is a vertical sectional view, with some parts in elevation, of a portion of the cylinder head of an internal combustion engine incorporating another dual follower mechanism embodying the features of the present invention for varying the timing of the valves of the engine.

Referring now to FIG. 17, another dual follower variable valve timing mechanism embodying the features of the present invention is illustrated and indicated generally at 145. The mechanism 145 incorporates components the same as or generally similar to those of the mechanism 25 of the previous embodiment. Consequently, like reference numerals have been employed to identify the parts of the mechanism 145 identical with those of the mechanism 25.

The mechanism 145 is shown as it would appear when installed in the cylinder head, indicated at 150, of a multi-cylinder, internal combustion engine. The engine includes a cylinder block (not shown) having a plurality of cylinders (also not shown) therein and a plurality of pistons, (likewise not shown) which are mounted in the cylinders for reciprocating movement.

The cylinder head further includes intake and exhaust passages for each cylinder, and at least one intake and one exhaust valve for controlling the flow of gases through the intake and exhaust passages, respectively. As illustrated in FIG. 17, one of the intake valves of the engine is indicated generally at 31. The stem and other portions of the valve 31 are identical with those in the previous embodiment. Accordingly, a further description of these components will not be included.

According to the present invention, the mechanism 145 includes cam means, indicated generally at 160, for effecting rocking movement of the rocker arm 46 and opening and closing of the valve 31, and dual follower means comprising a first follower means 161 engaged with the cam means 160 and a second follower means or member 162 engaged with the first follower means 161 and the ball 56 in the end 53 of the rocker arm 46. The second follower member 162 is of substantially the same shape and performs substantially the same function as the second follower member 62 of the mechanism 25.

Accordingly, reference should be made in this specification to the description and operation of the second follower member 62 of the mechanism 25 for an understanding of the construction and operation of the second follower member 162.

Each cam means 160 is preferably formed integrally with the camshaft 159, which extends lengthwise of the cylinder head 150. Thus, each cam means 160 is preferably of the conjugate type and includes a central, first radial cam member 163 and at least one and preferably a pair of axially-spaced, second radial cam members 164 and 165, respectively disposed on opposite sides of the central cam member 163. The base circle portion of the central cam member 163 is indicated at 166 and the base circle portions of the cam members 164 and 165 are each indicated at 167. The opening and closing ramp portions of the cam member 163 are respectively indicated at 168 and 169, and the opening and closing ramp portions of the cam members 164 and 165 are respectively indicated at 172 and 173. The transition points between the base circles 166 and 167 and opening ramp portions 168 and 172 of the cam members 163–165, are indicated at 174 in FIG. 17 and the transition points between the closing ramp portions 169 and 173 and the base circle portions 166 and 167 of the cam members 164, 165 are indicated at 176 in FIG. 17. The high point of the cam member 163 is indicated at 177 and the high points of the cam members 64 and 65 are indicated at 178.

Figure 18:
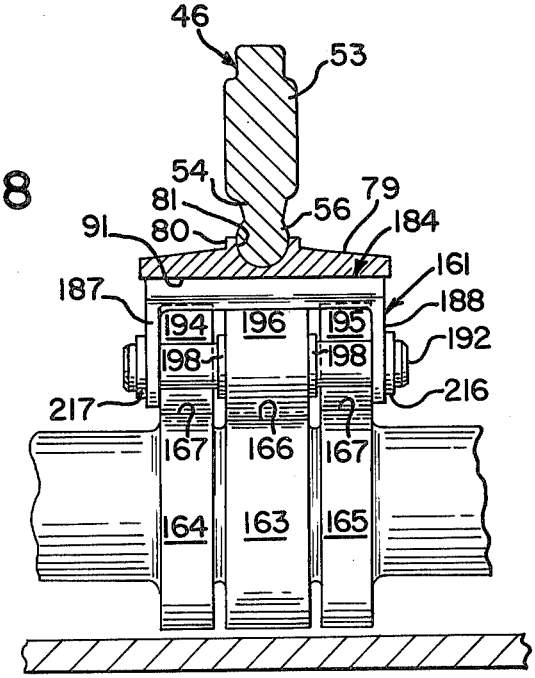
FIG. 18 is a fragmentary, vertical sectional view, with some parts in elevation, taken substantially along the line 18—18 of FIG. 17.

Referring now to FIG. 18 in conjunction with FIG. 17, it will be seen that the first follower means 161 comprises a generally inverted, channel-shaped, support member having a transversely spaced pair of leading and trailing portions 184 and 186, respectively, and a pair of depending, laterally spaced flange portions 187 and 188. A pair of laterally extending shafts 192 and 193 are supported in the flange portions 187 and 188, and cam follower members in the form of a pair of laterally-spaced rollers 194 and 195 on the shaft 192 and a roller 196 on the shaft 193. The roller 196 may be retained in centered relationship between the rollers 194 and 195 by snap rings 198 (FIG. 18) while the overlapping relationship of the rollers 194 and 195 with the roller 196 serves to retain these rollers in laterally spaced relation in the support member 161. The rollers 194 and 195 thus respectively ride on the cam members 164 and 165, and the central roller 196 rides on the cam member 163.

According to the present invention, the distance between the high point 177 and 178 of the cam members 163 and 164,165 is substantially equal to the distance between the points of contact of the rollers 196 and 194,195 with their base circle portions 166 and 167, respectively. The points of contact of the rollers 194,195 with their base circles 167 are indicated at 202 in FIG. 17, and the point of contact of the roller 196 with its base circle 166 is indicated at 203.

Movement of the follower means 161 is transmitted to the crescent-shaped, second follower means 162 by contact with upper, control surfaces, indicated at 204 and 206, respectively, of the leading and trailing portions 184 and 186 of the follower means 161. The control surfaces 204 and 206 are preferably convex and have a radius of curvature less than that of the undersurface 91 of the second follower member 162. Shifting movement of the follower means 161 in a direction substantially transverse to the direction of movement imparted thereto by the cam means 160 is effected by operating means which includes at least one and preferably a pair of laterally-spaced links 216 and 217 (FIGS. 17 and 18) only the link 216 being shown in FIG. 17. The links 216 and 217 are shiftable transversely in the same manner as the links 116 and 117 of the mechanism 25, i.e. by at least one crank 222 having its upper end connected to the outer ends of the links 216 and 217 by a pin 223 which passes through the links and the crank. The lower end of the link 222 is secured to a shaft 227, which is mounted for limited rotational movement in bosses, one of which is indicated at 228 in FIG. 17 and carried on the side wall, indicated at 229, of the cylinder head 150. When the crank 222 is in its full line position illustrated in FIG. 17, the position of the first follower member 161 is such as to cause the timing of the valve 31 to be of "intermediate" duration. As in the previous embodiments, the shaft 227 is rotatable in opposite directions to cause the crank 222 to swing between positions thereof providing "short" and "long" duration timing of the valve by a control mechanism (not shown) which is responsive to one or more operating conditions of engine, such as engine speed and manifold vacuum. The shaft 227 could, however, be rotated manually to cause the crank 222 to swing between angular positions, relative to the intermediate position thereof illustrated in FIG. 17, to provide "short" and "long" duration timing of the valve 31.

Figure 19:
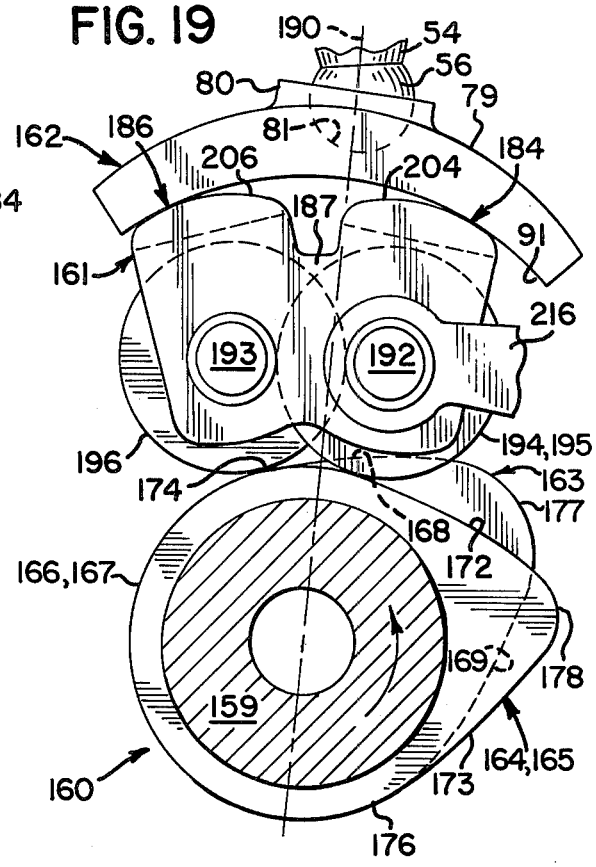
FIGS. 19 and 20 are enlarged views of the principal components of the dual follower variable valve timing mechanism illustrated in FIG. 17 and showing the positions of the rollers in relation to the cams thereof when the mechanism has been adjusted to cause the open period of the associated valve to be of intermediate duration and the valve is starting to lift and is about to close, respectively.
Figure 20:
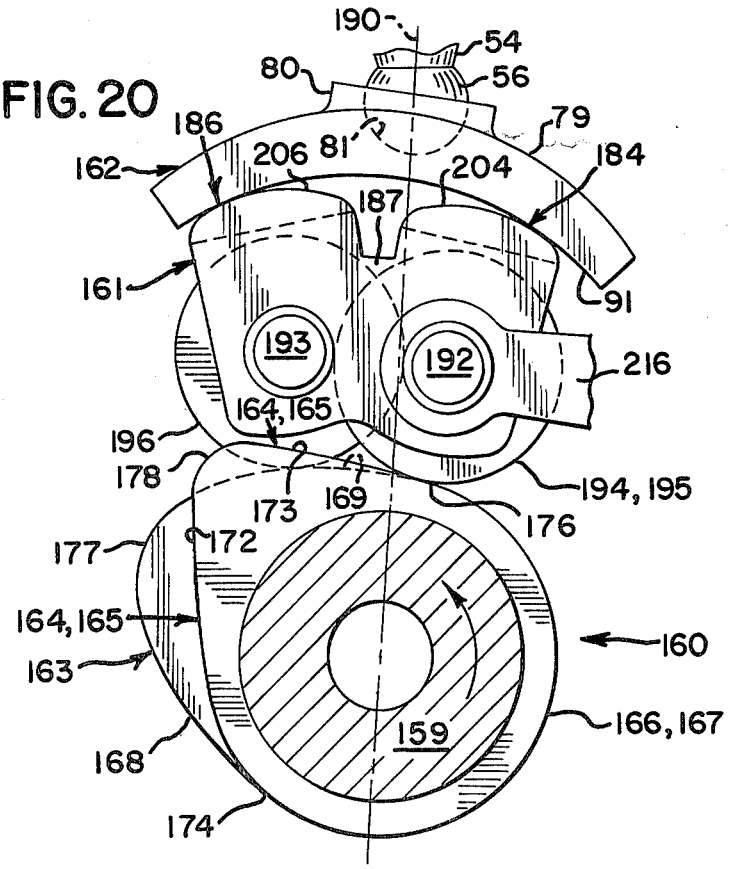

Referring now to FIGS. 19 and 20 in conjunction with FIGS. 17 and 18, the positions of the rollers 194,195 and 196 of the mechanism 145 with respect to their respective cam members 164,165 and 163 at the beginning and end of the lift cycles of the valve 31, and with respect to the line of action, approximately indicated at 190 in these figures, of the force exerted by the cam means 160 on the ball 56 of the rocker arm 46, is illustrated. Specifically, FIG. 19 illustrates the positions of the principal components of the mechanism 145 after the opening ramp portions 172 of the cam members 164 and 165 have engaged the rollers 194 and 195 and just before the opening ramp portion 168 of the cam member 163 engages the roller 196.

Continued rotation of the cam means 160 in a counterclockwise direction from the position thereof illustrated in FIG. 19 to the position thereof illustrated in FIG. 20 will result in a lift curve of the valve 31 which is an integrated composite of the curves that would be obtained from either the cam members 164,165 or the cam member 163 alone. This is due to the fact that the line of action 190 of the force exerted by the cam means 160 passes between the rollers 194,195 and 196 and the points of contact of the upper control surfaces 204 and 206 of the leading and trailing portions 184 and 186, respectively, with the control surface 91.

FIG. 20 illustrates the positions of the principal components of the mechanism 145 shortly before the valve 31 reaches its closed or seated position. Specifically, FIG. 20 illustrates the positions of the parts of the mechanism 145 when the rollers 194,195 have reached the transition points 176 on the cam members 163,164 and 165 and are about to engage the base circle portions 167 and shortly before the roller 196 moves off of the closing ramp portion 169 of the cam member 163 and onto the base circle portion 166.

Figure 21:
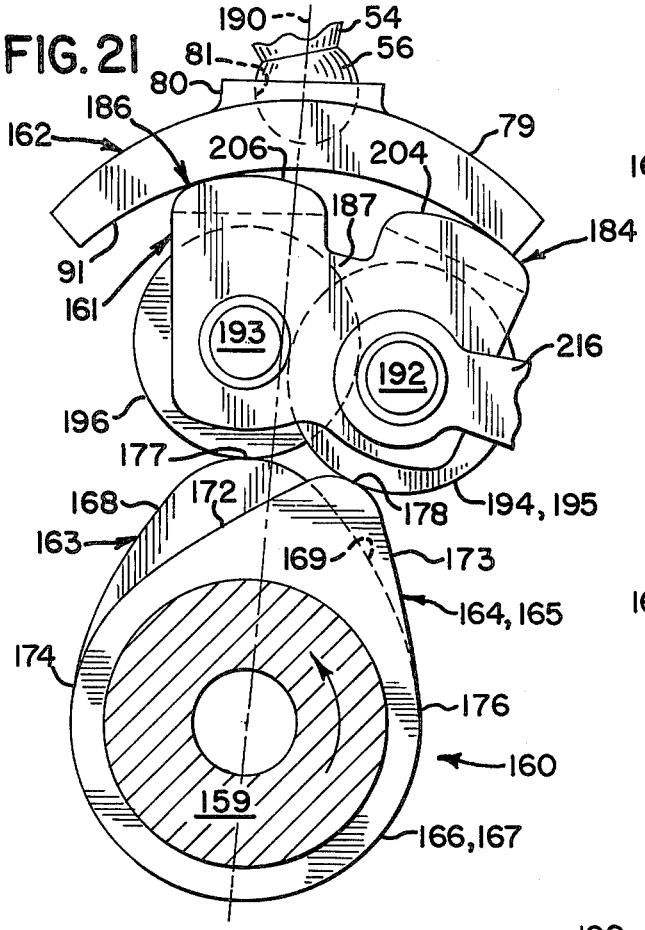
FIG. 21 is an enlarged view of the principal components of the dual follower variable valve timing mechanism illustrated in FIG. 17 and showing the approximate position of the parts thereof when the mechanism has been adjusted to cause the open period of the associated valve to be of relatively long duration and showing the positions of the rollers with respect to the cams when the valve is at maximum lift.
Figure 22:
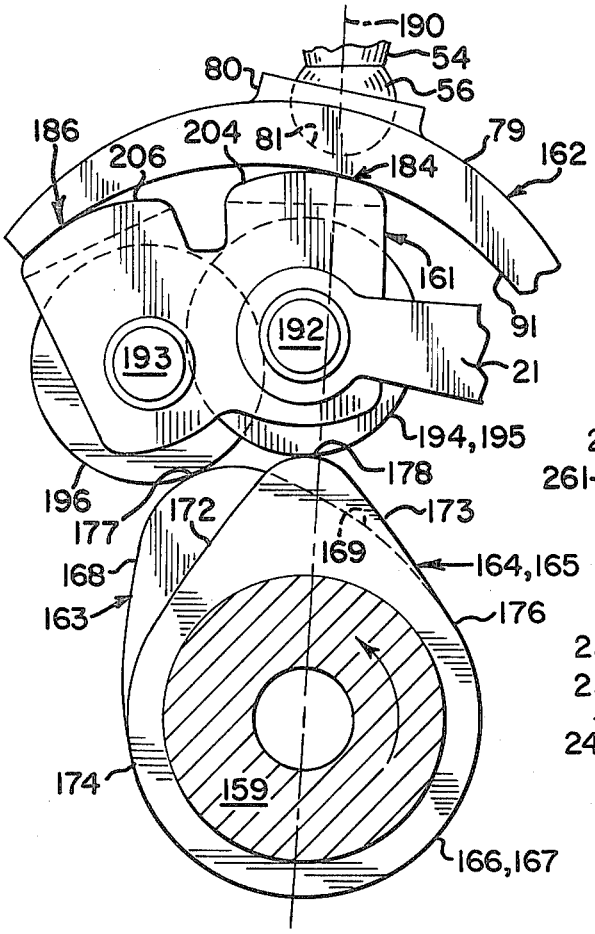
FIG. 22 is an enlarged view of the principal components of the dual follower variable valve timing mechanism illustrated in FIG. 17 and showing the approximate position of the parts thereof when the mechanism has been adjusted to cause the open period of the associated valve to be of relatively short duration and showing the positions of the rollers with respect to the cam when the valve is at maximum lift.

It will be understood that the first follower member 161 is transversely shiftable from the position thereof illustrated in FIGS. 17, 19 and 20 to positions which will change the timing of the valve to either a "short" or "long" duration, as in the previous embodiment. Thus, FIG. 21 illustrates the position of the first follower member 161 when the latter has been shifted to a position such as to cause the timing of the valve to be of "long" duration and FIG. 22 illustrates the position of the first follower member 161 when the latter has been shifted to a position to provide a "short" timing duration of the valve.

Since the first follower member 161 of the mechanism 145 utilizes rollers for transmitting the relative movements of the cam members 164,165 and 163 to the second follower member 162, the mechanism 145 is less subject to wear and capable of operation at high engine speeds.

THE DUAL FOLLOWER VARIABLE VALVE TIMING MECHANISM 245

Figure 23:
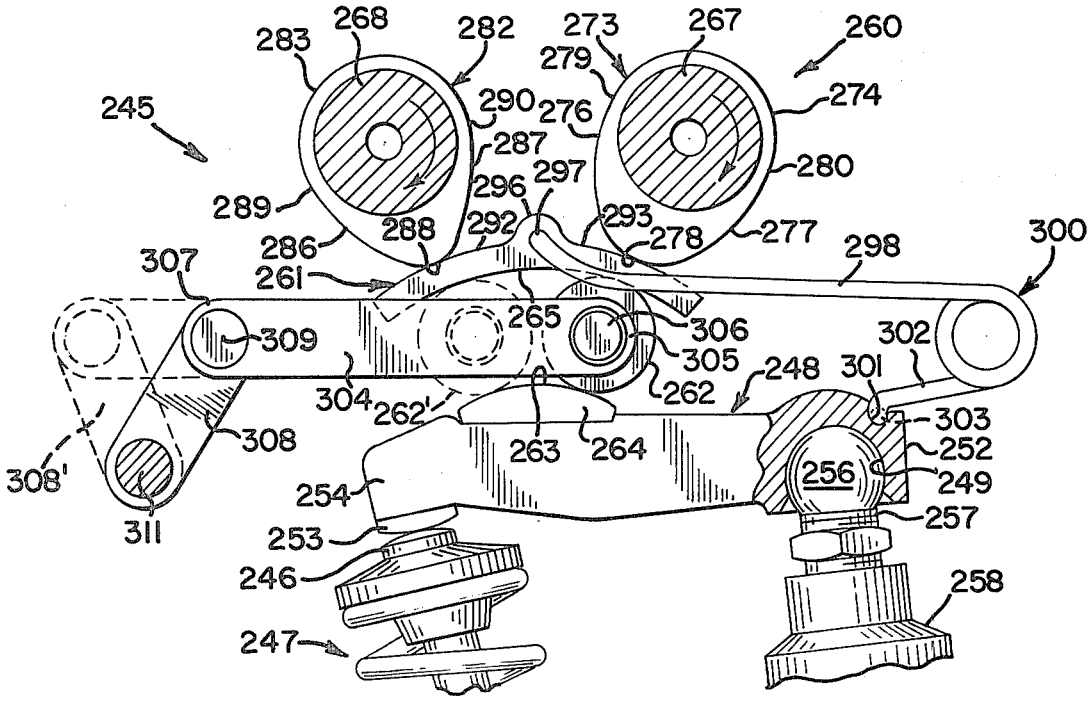
FIG. 23 is a vertical sectional view with some parts in section and others broken away to show internal details of an overhead camshaft version of another dual follower variable valve timing mechanism embodying the features of the present invention for varying the timing of the valves of the engine and showing the approximate positions, in full and broken lines, of one of the followers of the mechanism when the latter has been adjusted to cause the open period for the associated valve to be of relatively long and relatively short duration, respectively.

Referring now to FIG. 23, the principal components of another dual follower variable valve timing mechanism embodying the features of the present invention is illustrated in FIG. 23 and indicated generally at 245. The mechanism 245 differs from the previous embodiments in that the short and long duration cams of the mechanism are provided on separate camshafts, and the lift curve of the associated valve is achieved by shifting the point of engagement of one of the follower members with respect to the other follower member and a rocker arm of the valve actuating linkage so that the motion imparted to the rocker arm by the cams is selectively and infinitely variable.

Thus, as will be seen in FIG. 23, the linkage which transmits movement to the upper end, indicated at 246, of a valve, such as an intake valve 247, includes a rocker arm 248. The rocker arm 248 has a socket 249 in the underside of the right end 252 thereof, as viewed in FIG. 23, and a convex pad 253 on the underside of the left end thereof, indicated at 254. The socket 249 is adapted to receive a ball 256 that is formed on the upper end of the adjustable plunger, indicated at 257, of a lash adjuster, the upper end of which is fragmentarily shown in FIG. 23. The lower end of the lash adjuster 258 may be received, for example, in a bore (not shown) in the cylinder head (also not shown) of the engine, or in some other convenient retaining structure.

As previously mentioned, the mechanism 245 of the present invention includes cam means, indicated generally at 260 for effecting rocking movement of the rocker arm 248 and opening and closing of the valve 247, and dual follower means comprising a first follower means in the form of a crescent-shaped follower member 261 and second follower means in the form of a roller 262. The roller 262 engages a concave undersurface 265 on the follower member 261 and the convex upper surface, indicated at 263, of a pad or fulcrum member 264 on the upper surface of the rocker arm 248. The follower members 261 and 262 coact with the cam means 260 to vary the time and rate at which the valve 247 opens and closes, and the maximum lift of the valve, in order to achieve the advantages of the present invention.

As will be apparent from FIG. 23, the cam means 260 includes a pair of laterally spaced camshafts 267 and 268, respectively, which extend lengthwise of the cylinder head (not shown) of the engine and which are driven in the same direction and in timed relation with the speed of the engine. The camshaft 267 includes at least one radial cam member 273 having a base circle portion 274, opening and closing ramp portions 276 and 277, respectively, a high point 278 and transition points, approximately indicated at 279 and 280 and respectively disposed between the opening ramp portion 276 and base circle 274 and between the closing ramp portion 277 and base circle 274. The contour of the cam member 273 is such as will cause the timing of the valve 247 to be of "long" duration.

The camshaft 268 likewise includes at least one radial cam member 282 having a base circle portion 283, opening and closing ramp portions 286 and 287, respectively, a high point 288, and transition points, approximately indicated at 289 and 290 and disposed between the opening ramp portion 286 and base circle 283 and between the closing ramp portion 287 and base circle 283. The contour of the cam member 282 is such as will cause the timing of the valve to be of "short" duration. The timing diagrams illustrated in FIGS. 8 and 16 approximately illustrate the timing that will be obtained for the intake valve 247, and a corresponding exhaust valve, when the timing of the valves is controlled primarily by the cam member 282 or by the cam member 273, respectively.

As previously mentioned, the first follower member 261 is crescent-shaped and includes laterally spaced, convex, upper control surface portions 292 and 293, which respectively engage the cam members 282 and 273, and the under, concave control surface 265 which contacts the roller 262. A boss 296 is provided between the upper, control surface portions 292 and 293 of the follower member 261 for receiving the inturned end, indicated at 297, of one arm 298 of an expansion spring 300. The spring 300 also includes an arm 302 the end of which, indicated at 303, is seated in a recess 301 in the right end 252 of the rocker arm 248. The spring 300 serves to maintain the upper control surfaces 292 and 293 of the follower member 261 engaged with the cam members 273 and 282 while the mechanism 245 is in operation.

According to the present invention, operating means is provided for shifting the roller 262 in opposite directions and substantially transversely to the direction of movement imparted thereto by the follower member 261 and cam members 273 and 282. Such operating means thus preferably includes at least one and preferably a pair of laterally-spaced links, only one of which is shown in FIG. 23 and indicated at 304. Thus, the inner or right ends, indicated at 305, of the links are provided with openings for receiving the ends of a pin 306 on which the roller 262 is rotatably mounted. The outer or left ends, indicated at 307 of the links are connected to the upper end of a crank 308 as by a pin 309. The lower end of the crank 308 is secured to a shaft 311, which is mounted for limited rotational movement in bosses (not shown) on the cylinder head or elsewhere on the engine.

The shaft 311 is rotatable in opposite directions to cause the crank to swing between its full broken line positions, respectively indicated at 308 and 308' in FIG. 23, and corresponding movement of the roller 262 between its full and broken line positions, respectively, indicated at 262 and 262' in FIG. 23. Rotation of the shaft 311 in opposite directions is effected by a control mechanism (not shown) which is responsive to one or more operating conditions of the engine, such as engine speed and manifold vacuum. The shaft 311 could, however, be rotated manually to cause swinging movement of the crank 308 between the aforementioned angular positions.

Figure 24:
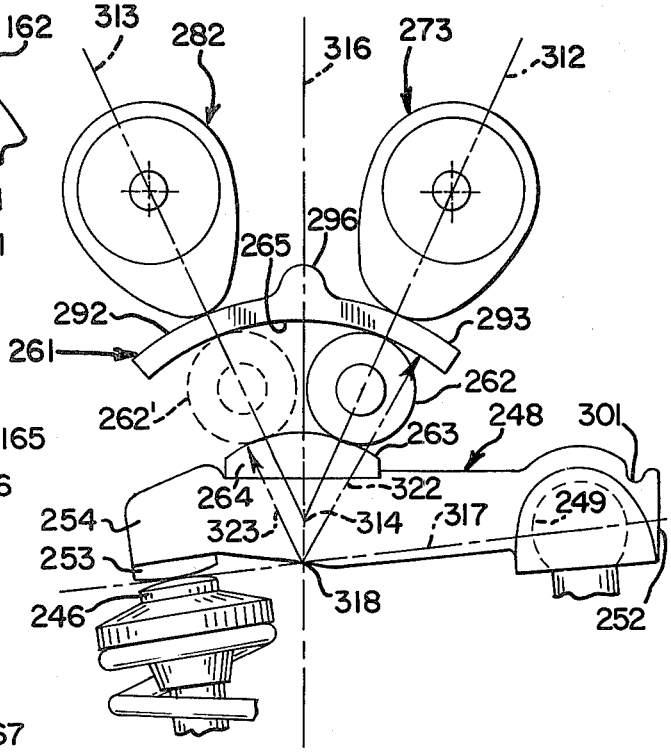
FIG. 24 is a diagrammatic view showing the geometric relationship of the principal components of the dual follower variable valve timing mechanism illustrated in FIG. 23 when the roller follower of the mechanism is in its adjusted limit position and also showing the approximate locations of the centers and lengths of the radii of curvature of the control surfaces which coact with the roller follower.

Referring now to FIG. 24 in conjunction with FIG. 23, the lines of action of the forces exerted by the cam members 273 and 282 on the crescent-shaped follower member 261 when the roller follower member is in its full and broken line limit positions 262 and 262', are indicated at 312 and 313, respectively. The lines of action 312 and 313 intersect at a point 314, which is within the envelope of the rocker arm 248 and which also lies on a line 316 that bisects the geometric center of the follower member 261 and pad 264. The line 316 also intersects a substantially horizontal line 317 which passes through the contact point of the upper end 246 of the valve 247 with the underside of the rocker arm pad 253 and through the geometric center of the hemispherical socket 249 in the right end 252 of the rocker arm 248. Thus, the point 314 lies above the point 318, which is also the center of the radius of curvature of the control surface 265 and the center of the radius of curvature of the upper surface 263 of the pad 264. The lengths of the radii of curvature of the surfaces 265 and 263 are approximated by the lengths of the arrows 322 and 323, respectively. The aforementioned locations of the points 314 and 318 in relation to the rocker arm 248 contributes to the smoothness and reliability of operation of the mechanism 245.

With the foregoing construction, it will now be appreciated that, when the control mechanism of the dual follower mechanism 245, acting through the crank 308, causes the roller 262 to shift to its full line position illustrated in FIGS. 23 and 24, the long duration cam 273 will primarily control the opening and closing times of the valve 247, the rate at which the valve opens and closes, and the maximum lift of the valve. Conversely, when the associated control mechanism causes the roller 262 to shift to its broken line position 262', the "short" duration cam 282 will primarily control the opening and closing times of the valve 247, the rate at which the valve opens and closes, and the maximum lift thereof.

Intermediate positions of the roller 262 between the full and broken line positions thereof illustrated in FIG. 23 will result in intermediate opening and closing times of the valve 247, as well as intermediate open periods and maximum lift of the valve. The mechanism 245 thus permits a precise and infinite variation of the aforementioned variables between the values obtained when the roller follower member 262 is in its full and broken line positions illustrated in FIG. 23.

While one or more embodiments of the invention have been herein illustrated and described, it will be understood that modifications and variations thereof may be developed which do not depart from the spirit of the invention and the scope of the appended claims.

It is claimed:

1. Mechanism for varying the time at which a valve for controlling the flow of fluid into or out of a combustion chamber of an internal combustion engine opens and closes, said combustion chamber being defined by a cylinder in the engine and piston means movable in the cylinder for varying the volume thereof, said engine also including a rotatable camshaft driven in timed relation with the speed of the engine and linkage means for transmitting reciprocating movement to said valve, said mechanism comprising cam means on said camshaft and including a first cam member adapted to effect movement of said linkage means and having a profile portion contoured to provide a first timing for said valve such as will provide optimum performance and efficiency of the engine throughout one set of operating conditions, said cam means also including a second cam member adapted to effect movement of said linkage means and having a profile portion contoured to provide a second timing for said valve such as will provide optimum performance and efficiency of the engine throughout another set of operating conditions, first follower means engaging said cam members and movable thereby, second follower means engaging said first follower means and said linkage means, said first and second follower means coacting with said cam members to proportion the movement imparted to said linkage means by said cam members, and operating means for varying the position of one of said first and second follower means with respect to the other of said first and second follower means and thus the time of, rate at which and extent of movement imparted by said first and second cam members to said linkage means and said valve.

2. The mechanism of claim 1, in which said operating means varies the position of said one follower means between a first position wherein the movement of said linkage means is effected primarily by said first cam member and a second position wherein the movement of said linkage means is effected primarily by said second cam member.

3. The mechanism of claim 2, in which said operating means includes link means connected to said one follower means and shiftable substantially transversely to said direction of movement imparted to said linkage means by said first and second cam members.

4. Mechanism for varying the time at which a valve for controlling the flow of fluid into or out of a combustion chamber of an internal combustion engine opens and closes, said combustion chamber being defined by a cylinder in the engine and piston means movable in the cylinder for varying the volume thereof, said engine also including a rotatable camshaft driven in timed relation with the speed of the engine and linkage means for transmitting reciprocating movement to said valve, said mechanism comprising cam means on said camshaft and including a first cam member adapted to effect movement of said linkage means and having a profile portion contoured to provide a first timing for said valve such as will provide optimum performance and efficiency of the engine throughout one set of operating conditions, said cam means also including a second cam member adapted to effect movement of said linkage means and having a profile portion contoured to provide a second timing for said valve such as will provide optimum performance and efficiency of the engine throughout another set of operating conditions, first follower means engaging said cam members and movable thereby, second follower means engaging said first follower means and said linkage means, said first and second follower means coacting with said cam members to proportion the movement imparted to said linkage means by said cam members, and operating means for varying the position of one of said first and second follower means with respect to the other of said first and second follower means and thus the time of, rate at which and extent of movement imparted by said first and second cam members to said linkage means and said valve, said linkage means including a rocker arm having opposite ends and mounted for movement about an axis that extends substantially parallel to the axis of said camshaft, said second follower means being mounted for and responsive to rocking movement of said rocker arm, and said first follower means having at least one nonplanar control surface engaging one or the other or both of said first and second cam members and another nonplanar control surface engaging a nonplanar control surface on said second follower means.

5. The mechanism of claim 4, in which a pair of said nonplanar control surfaces are provided on said first follower means for engaging said first and second cam members, the centers of the radii of curvature of said pair of nonplanar control surfaces are transversely spaced from each other and disposed substantially oppositely from the center of the radius of curvature of said other nonplanar control surface.

6. The mechanism of claim 5, in which the lengths of the radii of curvature of said nonplanar control surfaces of said first follower means are substantially equal.

7. The mechanism of claim 4, in which said nonplanar control surfaces on said first and second follower means comprise segments of cylinders.

8. The mechanism of claim 4, in which said first and second cam members have generally symmetrical profile portions having high points, and the high point of said second cam member is angularly displaced behind the high point of said first cam member with respect to the direction of rotation of said camshaft.

9. The mechanism of claim 8, in which the angle by which the high points of the first and second cam members are displaced is about 11 degrees with respect to the axis of rotation of said camshaft.

10. The mechanism of claim 8, in which said second cam member includes an axially spaced pair of second cam sections on said camshaft, and said first cam member is disposed between said pair of second cam sections.

11. The mechanism of claim 10, in which said first follower means has a first control surface portion adapted to engage said first cam member and a spaced pair of second control surface portions respectively adapted to engage said spaced pair of second cam sections.

12. The mechanism of claim 11, in which said first follower means has a pair of laterally spaced, leading sections and a central, trailing section, said first control surface portion is provided on said central trailing section, and said second control surface protions are provided on said laterally spaced, leading sections.

13. Mechanism for varying the time at which a valve for controlling the flow of fluid into or out of a combustion chamber of an internal combustion engine opens and closes, said combustion chamber being defined by a cylinder in the engine and piston means movable in the cylinder for varying the volume thereof, said engine also including a rotatable camshaft driven in timed relation with the speed of the engine and linkage means for transmitting reciprocating movement to said valve, said mechanism comprising cam means on said camshaft and including a first cam member adapted to effect meovement of said linkage means and having a profile portion contoured to provide a first timing for said valve such as will provide optimum performance and efficiency of the engine throughout one set of operating conditions, said cam means also including a second cam member adapted to effect movement of said linkage means and having a profile portion contoured to provide a second timing for said valve such as will provide optimum performance and efficiency of the engine throughout another set of operating conditions, first follower means engaging said cam members and movable thereby, second follower means engaging said first follower means and said linkage means, said first and second follower means coacting with said cam members to proportion the movement imparted to said linkage means by said cam members, and operating means for varying the position of one of said first and second follower means with respect to the other of said first and second follower means and thus the time of, rate at which and extent of movement imparted by said first and second cam members to said linkage means and said valve, said second cam member including an axially spaced pair of second cam sections on said camshaft, said pair of second cam sections being respectively arranged on opposite sides of said first cam member, said first follower means including a support member having laterally spaced flange portions and connecting, leading and trailing web portions, a pair of laterally spaced rollers being retatably carried by said flange portions in underlying relation with said connecting, leading web portion, said laterally spaced pair of rollers respectively engaging said second cam sections, another roller being rotatably carried by said flange portions in underlying relation with said connecting, trailing web portions, and said last mentioned roller being engaged with said first cam member and has at least a portion thereof extending between said laterally spaced pair of rollers and engaging said first cam member.

14. The mechanism of claim 13, in which said second follower means has a nonplanar control surface, and each of the leading and trailing connecting web portions of said support member has a nonplanar control surface engaging the nonplanar control surface of said second follower means.

15. The mechanism of claim 14, in which the radius of curvature of said nonplanar control surfaces of each of said connecting web portions is less than the radius of curvature of said nonplanar control surface of said second follower means.

16. The mechanism of claim 15, in which the nonplanar control surface of said second follower means comprises a segment of a cylinder.

17. Mechanism for varying the time at which a valve for controlling the flow of fluid into or out of the combustion chamber of an internal combustion engine opens and closes, said combustion chamber being defined by a cylinder in the engine and a piston means movable in the cylinder for varying the volume thereof, said engine also including linkage means including elongated rocker arm means for transmitting reciprocating movement to said valve, said rocker arm means having opposite ends, one of said ends engaging and being operable to effect movement of said valve to an open position, said mechanism comprising a pair of spaced, parallel, rotatably mounted camshafts disposed above and extending generally transversely to said rocker arm means, said camshafts being driven in timed relation with the speed of said engine, a first cam member carried by one of said camshafts and contoured to provide a first timing for said valve such as will provide optimum performance and efficiency of the engine throughout one set of operating conditions, a second cam member carried by the other of said camshafts and contoured to provide a second timing for said valve such as will provide optimum performance and efficiency of the engine throughout another set of operating conditions, first follower means engaging said first and second cam members and movable thereby, second follower means engaging said first follower means and said rocker arm means, said first and second follower means coacting with said cam members to proportion the movement imparted thereby to said rocker arm means, and operating means connected to said second follower means for varying the position thereof with respect to said first follower means and said rocker arm means and thus the time of, rate at which and extent of movement imparted to said valve by said first and second cam members.

18. The mechanism of claim 17, in which said first follower means has a first control surface having spaced portions engaged with said first and second cam members, said first follower means also has a second control surface engaged with said second follower means, and said rocker arm means has a control surface engaged with said second follower means.

19. The mechanism of claim 18, in which said second control surface of said first follower means and the control surface of said rocker arm means are nonplanar.

20. The mechanism of claim 19, in which said second control surface of said first follower means and the control surface of said rocker arm means are segments of cylinders.

21. The mechanism of claim 18, in which said second follower means comprises a roller, and said operating means comprises a link connected to said roller and operable to shift the same to different positions between said second control surface of said first follower means and said control surface of said rocker arm means.

* * * * *